United States Patent [19]

Redkey

[11] Patent Number: 4,909,515

[45] Date of Patent: Mar. 20, 1990

[54] GOLF PRACTICE CLUB

[76] Inventor: Robert H. Redkey, 1630 Maple, Solvang, Calif. 93463

[21] Appl. No.: 274,019

[22] Filed: Nov. 21, 1988

[51] Int. Cl.[4] ..... A63B 69/36

[52] U.S. Cl. ..... 273/186 A; 273/183 D; 273/199 R

[58] Field of Search ..... 273/186 A, 193 R, 193 A, 273/193 B, 194 R, 194 A, 194 B, 186 A, 167 A, 80.1, 164, 169, 167 E, 167 H, 167 J, 167 K, 175, 174

[56] References Cited

U.S. PATENT DOCUMENTS

| | | | |
|---|---|---|---|
| 1,531,821 | 3/1925 | Scott | 273/167 A |
| 2,621,044 | 12/1952 | Sloan | 273/194 A |
| 3,126,206 | 3/1964 | Sabia | 273/193 R |
| 3,341,203 | 9/1967 | Brill | 273/80.1 |
| 3,408,074 | 10/1968 | Antonious | 273/164 |
| 4,529,202 | 7/1985 | Jacobson | 273/169 |

*Primary Examiner*—George J. Marlo
*Attorney, Agent, or Firm*—Price, Gess & Ubell

[57] ABSTRACT

A golf practice aid providing a club head which simulates an actual putter head but having an opening, which with a proper stroke, may be swung over a golf ball without striking the same. An adapter is provided for orienting the club head with respect to a golf club shaft to achieve various shaft to club face positions.

7 Claims, 1 Drawing Sheet

GOLF PRACTICE CLUB

BACKGROUND OF THE INVENTION

1. Field of the Invention

The subject invention relates to sporting equipment, and more particularly to a golf practice club.

2. Description of the Prior Art

In the prior art, various aids have been suggested for improving the golf swing. These aids mainly involve alignment devices for aiding in proper club alignment. In general, improving the golf swing has typically involved repetitive hitting of the golf ball with the club. This, of course, entails the disadvantage of requiring a relatively large space and a supply of balls, which must be retrieved in some manner.

SUMMARY OF THE INVENTION

It is therefore an object of the invention to overcome the disadvantages of golf practice techniques which require hitting the golf ball;

It is another object of the invention to provide a new approach and apparatus for sharpening golfing skills;

It is another object of the invention to provide an improved golf practice aid;

It is another object of the invention to provide a golf practice aid and a game utilizing the same; and It is another object of the invention to provide a unique adapter for adjusting the shaft to club face position of a golf club.

According to the invention, a golf practice club is provided which contains an opening somewhat larger than a golf ball. The opening is designed such that when a perfect swing is made over the golf ball, the golf ball does not move. The ball will only be struck when the technique is imperfect in some manner.

The club and technique according to the invention may be used in a competitive game wherein imaginary putting greens are encountered and points scored based on the number of "perfect" putts, i.e., "misses" made.

An adapter is also disclosed for providing attachment of the shaft to the golf club head in straight or various offset positions.

BRIEF DESCRIPTION OF THE DRAWINGS

The just-summarized invention will now be described in detail in conjunction with the drawings of which.

DETAILED DESCRIPTION OF THE PREFERRED EMBODIMENTS

Figure 1:
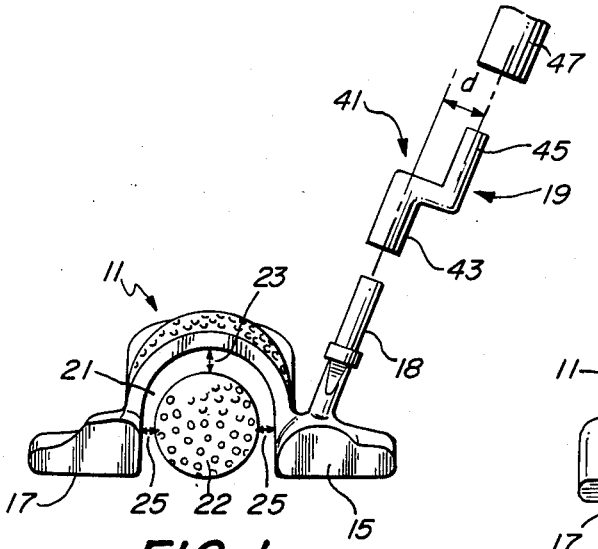
FIG. 1 is a front view of the preferred embodiment.

In the front view of FIG. 1, the preferred embodiment 11 is seen to include an arch 13, which integrally forms into first and second putter feet 15, 17. A stem 18 also integrally forms into the first putter foot 15, which is the one nearest the player when the preferred embodiment is in use. An optional adapter 19 is shown for varying offset of the club.

The arch 13 and inside surface of the putter feet 15, 17 provide an opening 21 about a standard golf ball 22. The diameter of such a standard golf ball is 1.68 inches. The opening 21 may provide a space 23 which is ¼-inch wide at the top 23 and spaces 25 of ⅛-inch on either side of the golf ball 22. The spaces 23, 25 may, of course, vary in width. Narrowing of the spaces 23, 25 provides an increase in the swing accuracy required of the golfer.

Figure 2:
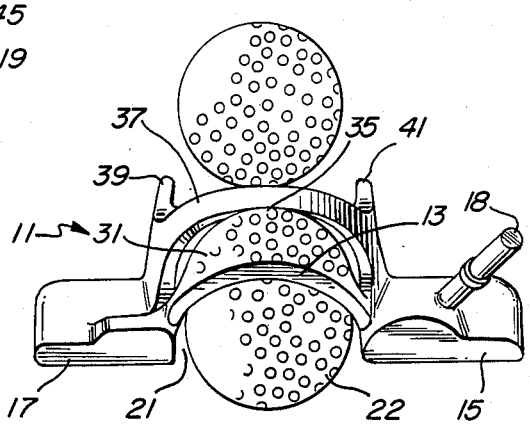
FIG. 2 is a front perspective view of the preferred embodiment.
Figure 3:
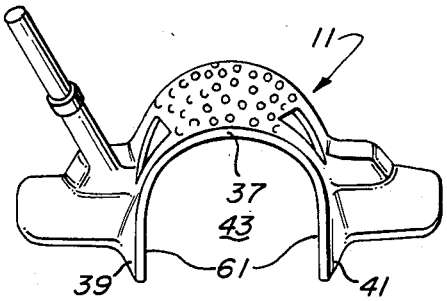
FIG. 3 is a rear perspective view of the preferred embodiment.

Referring to FIG. 2, the top of the arch 13 forms integrally into a hemispherical section 31, dimpled and sized to resemble a standard golf ball. The section 31 provides assistance in visually aligning the club for practice putts. The back portion 35 of the hemispherical section 31 forms into a rear arch 37, which descends and forms into two rearwardly extending guide fins 39, 41.

Figure 4:
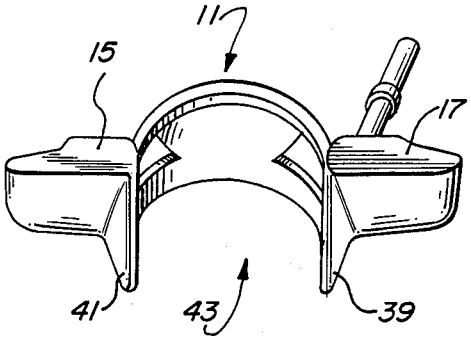
FIG. 4 is a side perspective view illustrating the underside of the preferred embodiment.

The interior 43 of the preferred embodiment 11 is preferably of uniform cross-section. As indicated in FIG. 4, the interior surfaces of the putter feet 15, 17 cooperate with those of the guide fins 39, 41 to form a channel of uniform width through the interior of the club and defining parallel linear edges 61.

In use, the practice club 11 is swung over the golf ball 22. A perfect swing results in no movement of the ball 22, while a less perfect swing may just nick the ball, or may move it substantially.

To make a perfect putt, the golfer must practice and achieve the skills of keeping the eyes on the ball, keeping the head down, making a perfect back and forward stroke, and making a perfect follow through. As skills increase, a club with a narrower opening may be used to increase the challenge.

Figure 5:
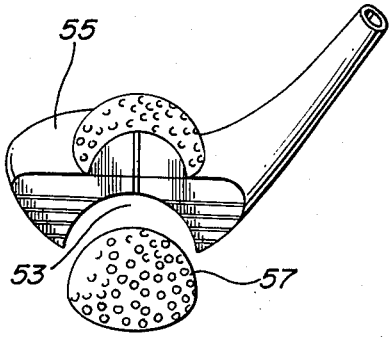
FIG. 5 illustrates an alternate embodiment.

While the preferred embodiment is a putter, the technique can also be applied to woods and irons by providing a cutout therein. For example, FIG. 5 illustrates an opening 53 in a wood 55, which may be swung over a half ball section 57.

The preferred embodiment may be made as an integral club head by conventional casting techniques, although other methods of forming individual pieces and attaching them together or forming an integral unit could be employed.

The club according to the preferred embodiment may be used to play a game involving competition between two players, each using a practice club according to the preferred embodiment. The players pretend they are putting a series of greens and keep score according to the following rules:

1. A player gets − (minus) one point for not hitting the ball.
2. A player gets + (plus) one point if the ball is just nicked.
3. A player gets + two points if the ball is moved over two inches (bad putt).
4. A player is through putting a hole if he or she gets a = putt (did not hit ball).
5. If a player gets a − one putt, he or she tries again.
6. If a player gets a + two putts, he or she tries again.
7. Score is kept on each hole; the most + putts a player may get on each hole is + four. Play is 18 holes.
8. To keep score − from 72.
   To keep score + to 72.
   −18 would be perfect putting.
   + means keep practicing putting skills.

FIG. 1 also illustrates an adapter 41 for providing various offsets, such as heel or toe offset, to the club. The adapter 41 consists of a hollow cylindrical metal receptacle 43 and a solid cylindrical plug 45, offset from one another by a distance "d". The receptacle 43 receives the stem 18 of the club head 11 and the other receives the shaft 47 used to swing the club. The receptacles 43, 45 have a diameter selected to provide a press-fit attachment to the two shafts 18, 47. Thus, the adapter 41 may be popped off and its position rotated to obtain various desired offsets and hence various "shaft to club face" positions. Reducing the distance "d" to zero provides a straight attachment adapter, providing no offset.

As will be understood, the foregoing embodiments are subject to numerous adaptations and modifications without departing from the scope and spirit of the invention. Therefore, it is to be understood that within the scope of the appended claims, the invention may be practiced other than as specifically described herein.

What is claimed is:

1. A golf practice device, comprising:

an integrally formed unitary structure, said structure including;

a channel of uniform cross-section having first and second parallel walls, the beginning of each wall being defined by a parallel linear edge;

first and second putter feet, each integrally formed with a respective one of said first and second parallel walls; and said channel forming an opening sized for passing over a golf ball resting on the ground when a proper putting swing is made, said putter feet being shaped and positioned such that said device simulates the placement of an actual putter on the playing surface.

2. A golf practice device for practicing putting, comprising:

an integrally formed structure, said structure including;

a channel of uniform cross-section having first and second parallel walls, the beginning of each wall being defined by a parallel linear edge;

front arch means forming a semicircular arch centrally disposed above said channel, the front contour of said semicircular arch terminating at first and second end points, each end point being coterminous with the beginning of a respective one of said parallel linear edges;

rear arch means formed integrally with said front arch means for defining a rear arch above said channel;

first and second putter feet, each integrally formed with a respective one of said first and second parallel walls; and said channel and front and rear arch means forming an opening for passing over a golf ball when a proper swing is made, said putter feet being positioned such that said device simulates the placement of an actual putter on the playing surface.

3. A golf practice device for practicing putting, comprising:

an integrally formed one-piece structure including;

a semicircular arch, each end of said arch extending to form a pair of parallel linear edges;

a spherical section formed integrally with said arch and extending behind said arch, said section being dimpled to resemble a golf ball;

a channel of uniform cross-section having first and second parallel walls, the beginning of each wall being defined by a respective one of said parallel linear edges, said channel extending beneath said spherical section;

first and second putter feet, each integrally formed with a respective one of said first and second parallel walls; and said channel and semicircular arch being shaped to pass over a golf ball when a proper putting swing is made.

4. The device of claim 3 further including a rear arch having a semicircular top portion into which said spherical section is integrally formed and which is integrally formed with said channel.

5. The device of claim 4 wherein said rear arch extends to form a pair of parallel spaced-apart, rearwardly-extending guide fins.

6. The device of claim 5 wherein said channel is of a width wider than the diameter of a standard golf ball, said width being selected to pass said ball when a proper putting swing is made.

7. The device of claim 5 wherein said channel is substantially ¼-inch wider than the diameter of a golf ball and said front semicircular arch extends substantially ¼-inch above a standard golf ball.

* * * * *